US005552221A

United States Patent [19]

So et al.

[11] Patent Number: 5,552,221

[45] Date of Patent: Sep. 3, 1996

[54] POLYBENZAZOLE FIBERS HAVING IMPROVED TENSILE STRENGTH RETENTION

[75] Inventors: Ying H. So; Steven J. Martin; Chieh-Chun Chau; Ritchie A. Wessling; Ashish Sen, all of Midland, Mich.; Katsuhiko Kato, Ikeda, Japan; Daniel B. Roitman, Menlo Park, Calif.; Willie E. Rochefort, Corvallis, Oreg.

[73] Assignee: The Dow Chemical Company, Midland, Mich.

[21] Appl. No.: 366,346

[22] Filed: Dec. 29, 1994

[51] Int. Cl.[6] ..... B32B 5/02; C08G 73/22

[52] U.S. Cl. ..... 428/373; 528/322; 528/327; 528/331; 528/340

[58] Field of Search ..... 528/183, 322, 528/327, 331, 337, 340, 342; 428/373; 264/331 R

[56] References Cited

U.S. PATENT DOCUMENTS

| | | | |
|---|---|---|---|
| 3,942,950 | 3/1976 | Powers et al. | 8/599 |
| 4,048,139 | 9/1977 | Calundann et al. | 524/88 |
| 4,112,016 | 9/1978 | Moulds | 525/428 |
| 4,525,384 | 6/1985 | Aoki et al. | 427/174 |
| 4,680,221 | 7/1987 | Murayama et al. | 428/246 |
| 4,707,231 | 11/1987 | Berger | 204/164 |
| 4,857,244 | 8/1989 | Berger | 264/24 |
| 4,913,938 | 4/1990 | Kawakami et al. | 427/383.1 |
| 4,961,971 | 10/1990 | Pike | 427/376.2 |
| 5,017,420 | 5/1991 | Marikar et al. | 428/212 |
| 5,021,258 | 6/1991 | McGarry | 427/35 |
| 5,296,185 | 3/1994 | Chau et al. | 264/205 |

FOREIGN PATENT DOCUMENTS 0332919 2/1989 European Pat. Off. .

OTHER PUBLICATIONS

Chemical Abstract 81:122715e (1974).
Chemical Abstract 84:152122 (1976).
Chemical Abstract 84:152123 (1976).
Chemical Abstract 90:122950 (1978).
Chemical Abstract 109:192065p (1988).
Chemical Abstract 110:136646 (1988).
Chemical Abstract 111:234961 (1989).
Chemical Abstract 112:22285 (1989).
Chemical Abstract 114:63308z (1990).
Derwent 82079W/50 (1975).
Derwent 86–039623/06 (1985).
Derwent 86–321415/49 (1986).
Derwent 89–073458/10 (1989).
Derwent 89–140892/19 (1989).
Derwent 91–234174/32 (1991).
Research Disclosure 19528 (1980).
McGarry et al., *Ceramic Coated Rigid Rod Polymer Fibers*, Sampe Quarterly, 23(4), pp. 35–38 (1992).
Rabek, Jan F., *Mechanisms of Photphysical Processes and Photochemical Reactions in Polymers*, pp. 329–330 (1987).
Schmitt et al., *Investigation of the Protective Ultraviolet Absorber in a Space Environment*, Journal of Applied Polymer Science, vol. 7, pp. 1565–1580 (1963).

*Primary Examiner*—Shelley A. Dodson

[57] ABSTRACT

Described is a method for preparing a polybenzazole filament which comprises extruding a polybenzazole dope filament, drawing the filament across an air gap, coagulating and washing the filament, and drying the filament, characterized in that a solution of a compound selected from the group consisting of ferrocenes, ruthocene, iodide-, cobalt-, and copper-containing compounds, dyes, and mixtures thereof is contacted with a filament subsequent to the washing step and prior to the drying step. This method provides a means to improve the tensile strength retention of damaged polybenzazole filaments following exposure to sunlight.

22 Claims, No Drawings

POLYBENZAZOLE FIBERS HAVING IMPROVED TENSILE STRENGTH RETENTION

BACKGROUND OF THE INVENTION

This invention relates to articles prepared from polybenzazole polymers. More particularly, this invention relates to fibers and fiber filaments prepared from polybenzazole polymers.

Fibers and fiber filaments comprised of polybenzoxazole (PBO), polybenzimidazole (PBI) and polybenzothiazole (PBT) polymers (hereinafter referred to as PBZ or polybenzazole polymers) are known and may be prepared, for example, by extruding a solution of the polymer through a die or spinneret, drawing the dope filament across an air gap, with or without stretching, and then washing the filament in a bath comprising water or a mixture of water and an acid solvent, and then dried.

When exposed to oxygen and light with a wavelength in the range of sunlight, physically damaged polybenzazole filaments tend to lose a substantial portion of their tensile strength. Damage to the filaments may be caused by folding them over themselves (such as in a knitting process) or otherwise subjecting them to shear forces which produce "kink bands" in the filaments. Kink bands may be observed as dark bands in the filament, which are visible under 200× magnification. While undamaged filaments generally do not experience a significant loss in tensile strength following exposure to sunlight, damage to the filament is difficult to avoid when the filament is part of a multifilament fiber which is used in an application which requires the fiber to be knitted or otherwise woven into the shape of an article or a fabric. It would be desirable to increase the ability of polybenzazole fibers to retain their tensile strength after damage.

SUMMARY OF THE INVENTION

In one aspect, this invention is a method for preparing a polybenzazole filament which comprises extruding a polybenzazole dope filament, drawing the filament across an air gap, washing the filament, and drying the filament, characterized in that a solution of a compound selected from the group consisting of ferrocenes, ruthocene, iodide-, cobalt-, and copper-containing compounds, dyes, and mixtures thereof is contacted with a filament subsequent to the washing step and prior to the drying step.

In a second aspect, this invention is a method for preparing a polybenzazole filament which comprises extruding a polybenzazole dope filament, drawing the filament across an air gap, washing the filament, and drying the filament, characterized in that the polybenzazole dope comprises at least about 0.5 percent by weight, based on the weight of the polybenzazole polymer, of a dye compound.

It has been discovered that the process of the invention provides a means to improve the tensile strength retention of damaged polybenzazole filaments, following exposure to sunlight, relative to filaments which have not been infiltrated with such compounds. It is believed, without intending to be bound, that decreases in tensile strength of a filament are due to photooxidative degradation of the polymer. Damage to the filament permits oxygen to enter the otherwise impermeable filament, thereby decreasing the amount of light energy necessary for the degradation reaction to initiate at the site of such strain. The infiltrating compound is believed (without intending to be bound) to either block the transmission of light through the filament (as is believed to be the case with a dye) or undergo reversible electron transfer, thereby bringing oxygen and polybenzazole ion radicals present in the filament to their corresponding stable neutral species (as is believed to be the case with the ferrocene and iodide compounds). These and other advantages of the invention will be apparent from the description which follows.

DETAILED DESCRIPTION OF THE INVENTION

The term "polybenzazole polymer" as used herein refers to a polymer from the group of polybenzoxazoles (PBO), polybenzothiazoles (PBT) and polybenzimidazoles (PBI). For the purposes of this application, the term "polybenzoxazole" (PBO) refers broadly to polymers in which each unit contains an oxazole ring bonded to an aromatic group, which need not necessarily be a benzene ring. As used herein, the term polybenzoxazole also refers broadly to poly(phenylene-benzo-bis-oxazole)s and other polymers wherein each unit comprises a plurality of oxazole rings fused to an aromatic group. The same understandings shall apply to the terms polybenzothiazole (PBT) and polybenzimidazole (PBI). As used in this application, the term also encompasses mixtures, copolymers and block copolymers of two or more PBZ polymers, such as mixtures of PBO, PBT and/or PBI and block or random copolymers of PBO, PBI and PBT. Preferably, the polybenzazole polymer is a lyotropic polymer (i.e., it becomes liquid crystalline at certain concentrations in mineral acids), and is most preferably a polybenzoxazole polymer.

A solution of PBZ polymer in a solvent (a polymer "dope") may be conveniently prepared by polymerizing the polymer in a solvent acid. The solvent acid is preferably a mineral acid, such as sulfuric acid, methanesulfonic acid, or polyphosphoric acid, but is most preferably polyphosphoric acid. The concentration of polymer in the dope is preferably in the range of from about 6 percent to about 16 percent.

Polybenzazole filaments for use in the process of the present invention may be prepared by the extrusion of a polybenzazole dope through an extrusion die with a small diameter or a "spinneret." The polybenzazole dope comprises a solution of polybenzazole polymer in the solvent acid. PBO, PBT and random, sequential and block copolymers of PBO and PBT are described in references such as Wolfe et al., *Liquid Crystalline Polymer Compositions, Process and Products*, U.S. Pat. No. 4,703,103 (Oct. 27, 1987); Wolfe et al., *Liquid Crystalline Poly(2,6-Benzothiazole) Compositions, Process and Products*, U.S. Pat. No. 4,533,724 (Aug. 6, 1985); Wolfe, *Liquid Crystalline Polymer Compositions, Process and Products*, U.S. Pat. No. 4,533,693 (Aug. 6, 1985); Evers, *Thermo-oxidatively Stable Articulated p-Benzobisoxazole and p-Benzobisthiazole Polymers*, U.S. Pat. No. 4,359,567 (Nov.16, 1982); Tsai et al., *Method for Making Heterocyclic Block Copolymer*, U.S. Pat. No. 4,578,432 (Mar. 25, 1986); 11Ency. Poly. Sci. & Eng., *Polybenzothiazoles and Polybenzoxazoles*, 601 (J. Wiley & Sons 1988) and W. W. Adams et al., *The Materials Science and Engineering of Rigid-Rod Polymers* (Materials Research Society 1989), which are incorporated herein by reference. The polybenzazole polymer may be rigid rod, semi-rigid rod or flexible coil. Preferably, the polybenzazole polymer is polybenzoxazole or polybenzothiazole, but is most preferably polybenzoxazole.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992), which are incorporated herein by reference. In summary, suitable monomers are reacted in a solution of nonoxidizing and dehydrating acid under nonoxidizing atmosphere with vigorous mixing and high shear at a temperature that is increased in step-wise or ramped fashion from no more than about 120° C. to at least about 190° C.

The dope is formed into a filament by extruding through a spinneret and drawing across a gap. Suitable processes are described in the references previously incorporated and U.S. Pat. No. 5,034,250, which is also incorporated herein by reference. Dope exiting the spinneret enters a gap between the spinneret and the washing bath. The gap is typically called an "air gap" although it need not contain air. The gap may contain any fluid that does not induce solvent removal or react adversely with the dope, such as air, nitrogen, argon, helium or carbon dioxide.

Following the spinning of the filament, the filament is then washed to remove a portion of the solvent to prevent further excessive drawing or stretching of the filament, and then washed further and, optionally, neutralized with sodium hydroxide to remove most of the solvent present. The term "washing" as used herein refers to contacting the filament or fiber with a fluid which is a solvent for the acid solvent in which the polybenzazole polymer is dissolved, but is not a solvent for the polybenzazole polymer, in order to remove acid solvent from the dope. Examples of suitable washing fluids include water and mixtures of water and the acid solvent. The filament is preferably washed to a residual phosphorous concentration of less than about 8,000 ppm, more preferably less than about 5,000 ppm. Thereafter, the filament may be dried, heat-treated, and/or wound on rolls as desired. The term "drying" as used herein means to reduce the moisture content of the filament or fiber. Multifilament fibers containing PBZ polymers may be used in ropes, cables, fiber-reinforced composites and cut-resistant clothing.

In the process of the first aspect of the present invention, a solution of a compound selected from the group consisting of water-soluble ferrocenes, ruthocene, iodide-, cobalt-, and copper-containing compounds, dyes, and mixtures thereof is contacted with the exterior surface of a wet filament or multifilament fiber subsequent to the washing step of the process to make filament and/or fibers, but prior to or during the drying step. The solution may be physically applied to any suitable means, such as by spray devices, brushes, baths, or by any devices typically employed to apply a finish to a fiber, but is most preferably applied by immersion of the filament in the solution.

The process of the invention may be carried out by soaking the filament in a solution of the compound, but is preferably carried out in a continuous process by running the filament through a series of baths, or through washing cabinets which spray a solution of the compound onto the filament and allow the solution to remain on the filament for a desired residence time. Washing cabinets typically comprise an enclosed cabinet containing one or more rolls which the filament travels around a number of times, and across, prior to exiting the cabinet. As the filament travels around the roll, it is sprayed with a fluid. The fluid is continuously collected in the bottom of the cabinet and drained therefrom. Preferably, however, the process is carried out by running the filament through a bath or series of baths in a continuous process. In such processes, each bath preferably contains one or more rolls which the filament travels around many times before exiting the bath, in order to achieve a desired residence time (the time the filament is in contact with the solution).

During the infiltration process, the solution is allowed to remain in contact with the filament long enough to infiltrate or permeate the filament sufficiently to give the desired weight content of the compound. After the infiltration process, the filament preferably contains at least about 0.1 percent by weight of the compound, more preferably at least about 0.5 percent by weight, more preferably at least about 1.0 percent by weight, and most preferably at least about 1.5 weight percent of the compound, although the amount of compound which is effective to increase the tensile strength retention of the filament may vary between compounds. The infiltration process should be carried out after the filament has been washed, but while still wet. Likewise, the surface of the filament should not be allowed to dry between the beginning of the washing process and the end of the washing process (when a multi-step process is utilized). It is theorized, without intending to be bound, that the wet, never-dried filament is relatively porous and provides paths for the infiltrating solution to enter the filament. An appropriate residence time should be selected to allow a sufficient amount of the compound to infiltrate the filament. The rate at which the compound infiltrates the filament will depend on several factors, including the concentration of the compound in solution (less residence time needed at higher concentrations), line speed (in a continuous process), temperature (less residence time needed at higher temperatures), and the molecular size of the compound being infiltrated (less time needed for smaller molecules).

The infiltration process may be carried out at ambient temperatures, but elevated temperatures may be preferred for some compounds to increase their solubility and reduce the necessary residence time. It may also be desirable to infiltrate the fiber in an off-line process at elevated pressures, in order to decrease the necessary residence time. The infiltrating solution is preferably circulated to maintain a constant temperature and concentration. If the compound is an iodide compound, the infiltration process is preferably carried out in a bath which is covered to prevent light from entering or the solution from evaporating. As the filament exits the bath, it is preferably wiped with a wiping device, in order to remove surface residue. It may also be desirable to rinse or wash the filament under mild conditions in order to prevent excess compound from forming a residue on any equipment used to dry the filament, such as drying rolls.

The infiltrating solution will comprise the compound and a suitable solvent. If the compound is applied to the filament prior to drying, then an aqueous solution of a water-soluble compound is preferably used to infiltrate the filament. Alternatively, a water-miscible solvent, such as a ketone or alcohol may be used to prepare a solution of a compound which is not soluble in water. Mixtures of water and water-miscible solvents such as acetone or methanol may also be employed. If the compound is applied to the filament during the drying step, a solution of a water-soluble compound in a water-miscible volatile organic solvent is preferably used to infiltrate the filament. For example, in processes utilizing acetone as a drying agent, the compound may be conveniently applied to the filament by adding an acetone-soluble compound to the acetone prior to use in the drying operation. However, since the compound will more easily permeate the filament when it is saturated with water prior to the drying step, it is more preferably applied prior to the drying step. Organic solvents which are not water-miscible may also be used, but are less preferred.

In the process of the second aspect of the invention, the polybenzazole dope used to prepare the filament contains at least about 0.5 percent by weight, based on the weight of the polybenzazole polymer, of a dye compound. The dye compound may be incorporated into the dope by simply mixing the compound and the dope until a uniform mixture is obtained. Thereafter, the dope may be spun into a filament using the methods described above. Such dye compounds are preferably used in an amount, based on the weight of the dope, of at least about 1 percent, more-preferably at least about 1.5 percent, and most preferably at least about 2 percent; but preferably no greater than about 10 percent, more preferably no greater than about 7.5 percent, and most preferably no greater than about 5 percent, although the amount of compound which is 5 effective to increase the tensile strength retention of the filament may vary between compounds.

Suitable ferrocene and ruthocene compounds useful in the process of the invention include ruthocene and any coordination compound of ferrous iron and two molecules of substituted or unsubstituted molecules of cyclopentadiene, which compound is soluble in water or an organic solvent at a concentration of at least about 1 percent by weight. Examples of suitable ferrocene compounds include dicyclopentadienyliron, (ferrocenylmethyl)trimethylammonium iodide, 1,1'-ferrocenedimethanol, sodium ferroceneacetate, disodium 1,1'-ferrocenedicarboxylate, diammonium 1,1-ferrocenedicarboxylate, ammonium ferrocene carboxylate, (dimethylaminomethyl)ferrocene, ferrocene carboxylic acid, 1,1'-ferrocenedicarboxylic acid, but is most preferably diammonium 1,1-ferrocenedicarboxylate.

Preferably, the concentration of ferrocene and/or ruthocene compound in the infiltrating solutions is at least about 1 percent by weight, more preferably at least about 2 percent by weight; but is preferably no greater than about 10 percent by weight, more preferably no greater than about 8 percent by weight. Preferably, the residence time of the fiber in the infiltrating solution is at least about 3 seconds, more preferably at least about 10 seconds, more preferably at least about 1 minute, and most preferably at least about 5 minutes, but is preferably no longer than about 24 hours, more preferably no longer than about 2 hours. If ammonium ferrocene salts are used as the infiltrating compound, after infiltration, the fiber or filament is preferably heated to a temperature sufficient to substantially convert them to the corresponding carboxylic acids, which are less water-soluble (heating at 170° C. for about 10 minutes). This procedure may be particularly useful if the fiber is to be used in an application where it may come in contact with water or steam.

Suitable iodide-, copper-, and cobalt-containing compounds useful in the process of the invention include any salt, complex, or hydrate of iodide, copper, or cobalt which is soluble in water or an organic solvent at a concentration level of at least about 0.1 percent by weight and forms the ionic species of iodide, copper, or cobalt in solution. The residence time of the fiber in such solutions is preferably at least about 1 second, more preferably at least about 5 seconds; but is preferably no greater than about 60 seconds, more preferably no greater than about 20 seconds.

Examples of suitable iodide-containing compounds include potassium iodide, ammonium iodide, lithium iodide, calcium iodide, sodium iodide, as well as the corresponding hydrates and complexes thereof, but is preferably potassium iodide or sodium iodide. Preferably, the concentration of iodide-containing compound in the infiltration solutions is preferably at least about 0.1 percent by weight, more preferably at least about 0.5 percent by weight; but is preferably no greater than about 10 percent by weight, more preferably no greater than about 8 percent by weight.

Suitable copper-containing compounds include copper (II) bromide, copper (II) chloride, copper (II) acetate, copper sulfate, copper bromide, copper chloride, copper (II) carbonate, copper fluoride, copper chromate, and the corresponding hydrates and complexes thereof, but is preferably copper (II) bromide. The concentration of copper-containing compound in the infiltration solutions is preferably at least about 0.1 percent by weight, more preferably at least about 0.2 percent by weight; but is preferably no greater than about 10 percent by weight, more preferably no greater than about 6 percent by weight.

Suitable cobalt-containing compounds include cobalt (II) acetate, cobalt chloride, cobalt (II) nitrate, cobalt sulfate, cobalt (II) carbonate, as well as the corresponding hydrates and complexes thereof, but is preferably cobalt (II) acetate. The concentration of cobalt-containing compound in the infiltration solutions is preferably at least about 0.1 percent by weight, more preferably at least about 0.2 percent by weight; but is preferably no greater than about 10 percent by weight, more preferably no greater than about 6 percent by weight.

Suitable dye compounds useful in the processes of the invention include any compound which is not a difunctional monomer for the preparation of the polybenzazole polymer but absorbs light with a wavelength in the range of from about 300 nm to about 600 nm and is soluble at a concentration level of at least about 1 percent. Examples of such compounds include Naphthols and Acid Blacks, Blues, Fuchins, Greens, Oranges, Reds, Violets, Yellows, as described, for example, in the Aldrich Catalog of Fine Chemicals (1990), which absorb light in the above-described range. Preferably, the dye compound is Acid Black 48, Acid Blue 29, Primulin, Nuclear Fast Red, Acid Blue 40, Eosin Y (4,5-tetrabromofluorescein), Naphthol Yellow S, or Rhodamine B, but is most preferably Acid Black 48. The concentration of dye compound in the infiltration solutions is preferably at least about 1.0 percent by weight, more preferably at least about 1.5 percent by weight, and is preferably no greater than about 10 percent by weight, more preferably no greater than about 6 percent by weight. Preferably, the residence time of the fiber in the infiltration solution is at least about 3 seconds, more preferably at least about 6 seconds, more preferably at least about 30 minutes, and most preferably at least about 60 minutes, but is preferably no longer than about 48 hours, more preferably no longer than about 24 hours.

If a mixture of one or more of the above compounds is employed, the mixture preferably comprises copper and iodide, or cobalt and iodide. Alternatively, if more than one compound is applied, they may be applied in separate baths in a sequential manner, although they are preferably added to the same solution, since compounds infiltrated in a first bath may tend to wash out in subsequent baths. When mixtures of copper- and iodide-containing compounds are used, the weight ratio of I/Cu compounds is preferably at least about 50/50, more preferably at least about 70/30, and most preferably at least about 80/20.

ILLUSTRATIVE EMBODIMENTS

The following examples are given to illustrate the invention and should not be interpreted as limiting it in any way. Unless stated otherwise, all parts and percentages are given by weight.

Example 1

PBO Fiber Infiltrated with Ferrocenes

A fourteen weight percent solution of polybenzoxazole in polyphosphoric acid (having an inherent viscosity of about 27–30 dL/g, measured at 23° C., in a nearly saturated solution of methanesulfonic acid anhydride in methanesulfonic acid at a concentration of 0.046 g/dL) is prepared by polymerizing diaminoresorcinol .2HCl and terephthalic acid in polyphosphoric acid (enriched with $P_2O_5$ to provide a final $P_2O_5$ content of about 83.9 percent). The dope is then extruded under spinning conditions sufficient to produce a filament with a diameter of 11.5 microns and an average denier of about 1.5 denier per filament (when washed and dried). The filaments are spun at a spinning temperature of between 150° C. and 175° C. out of a spinneret with 31, 42, or 340 holes with equal diameters of 75, 160, or 180 microns which are arranged to extrude the filaments vertically downwards into a first washing bath, at which point they are combined into a multifilament fiber. A glass quench chamber is placed in the air gap between the spinneret face and the first washing bath in order to provide a more uniform drawing temperature. The air gap length (distance from the spinneret to the first washing bath) is in the range of from 15–40 cm. A 60° C. air or nitrogen flow is maintained in the gap, or the fiber is spun into air at ambient conditions. Spin-draw ratios utilized are 7.5 to 45 with fiber take-up speeds of 26 to 200 m/min. The initial washing of the fiber is carried out with a continuous flow of a 20 weight percent aqueous solution of polyphosphoric acid.

The partially washed PBO fiber samples are then further washed 'off-line' in water (immersion of spun yarn bobbins in water buckets) at a temperature between 23° C. and 100° C. from 10 seconds to 240 hours, to a phosphorous concentration of less than about 5,000 ppm. While still wet, the fibers are soaked in a 1 weight percent solution of the ferrocene compounds shown in Table 1. For Examples 1a–d and 1g–h, the fibers are soaked in the solutions for 24 hours, although shorter infiltration times are useful as well. For diammonium 1,1-ferrocene carboxylate (Examples 1g–h), the fiber is agitated in a 1 percent solution of the compound for about 10 minutes. For (dimethylamino-methyl) ferrocene, which has limited solubility in water, a mixture of water and the ferrocene compound is agitated with a pump to enable the ferrocene to infuse into the fiber.

The fibers are then dried under nitrogen at room temperature (23° C.) for an additional 48 hours. A portion of the fibers (Examples 1a, 1b, 1c, and 1d) are triple-dead-folded (as described below), coated with the solution of the ferrocene compound to apply the compound to the damaged areas, and photolyzed in the Suntest Unit (as described below) for 100 hours. The average tensile strength of the fibers decreases from 740±45 ksi to 344±30 ksi, for an average 46 percent retention of tensile strength.

A few PBO fiber samples (Examples j and k) are washed and treated with ferrocenes in an "on-line" mode. In such cases, the fibers leaving a first washing bath are next passed continuously to a second washing bath, and washed with water at 23° C. 'on-line' using two pairs of wash rolls, to residual phosphorous content of less than about 8,000 ppm. Ferrocene treatment is then performed "on-line" on a third pair of wash rolls. The turns of fiber on the roll are spaced 4mm apart, and the motors are set to turn the rolls at the same speeds. The residence time of the fiber in the ferrocene solution is in the range of from 7 seconds to 100 seconds. Thereafter, the samples are dried as described above for the samples washed off-line, and a few samples are heat-set as also described above.

Tensile Properties

Tensile properties are measured in accordance with ASTM D-2101, on an Instron™ 4201 universal testing machine. A 10 lb. load cell is used with a crosshead speed of 1.0 inches/min., and a gauge length of 10.0 inches. Tensile data is obtained using a twist factor of 3.5, and recorded on an X-Y strip chart recorder. The tensile strength data is reported as an average over at least 10 samples.

Certain PBO fiber samples are triple dead-folded prior to the photo-aging test as a laboratory means to damage and test the fiber without using a knitting/deknitting procedure. This test is also referred to hereafter as a "triple dead-fold" test or "3 DF." The procedure for this test is as follows: A 3-mil thick sheet of 8 ½"×11" paper is folded in half and creased along the fold. The paper is then unfolded and 10 or fewer fiber strands are taped to the paper lengthwise at both ends of the strands. The paper is then refolded along the existing crease, and a second piece of paper is placed inside the folded piece to push the fiber strands as close to the crease as possible. The fibers are then damaged at the point adjacent to the crease by pressing a 0.5 inch diameter marker pen across the length of the crease 4 times, while the creased paper containing the folded fibers is resting on a hard, flat surface. The force is applied as consistently as hand operation can achieve, and is in the range of about 10–15 pounds. The paper containing the fiber is then unfolded, and the pressing procedure is repeated after folding the paper along a line parallel to and 0.5 inches from the first crease, by folding in the same direction. The procedure is then repeated, folding the paper along a line 0.5 inches from the first crease, on the opposite side from the second crease.

For the tests wherein the fiber is knitted, the fiber strands are knitted on a Lawson-Hemphill Fabric Analysis Knitting machine equipped with a three inch diameter cylinder, using a 160 needle head. To help eliminate the effects of static electricity, a suspension of water and banana oil (approximately 200:1 ratio) is used as a knitting finish. Fiber strands 10–12 inches long are used for photo-aging and testing.

Photo-aging tests may be performed in a Suntest CPS (Controlled Power System, 765 watt/$m^2$ xenon irradiation, quartz filter, available from Heraeus) unit. The fibers are wound on a metal winding frame, and placed in the unit, which is operated at full intensity for about 100 hours. The temperature in the instrument chamber during the test is about 53° C. and the wavelength of the light is in the range of from 300–800 nm.

The data is shown below in Table 1. Maximum increase in photostability is observed with an iron (Fe) content of about 2 to 2.5 percent. Examples a–d are all prepared under a constant set of spinning conditions. The fiber used in Examples e–f, and g–k are also carried out using fiber from a single roll, although each group of examples may be carried out using fiber from a different roll. The "damage" test method for examples a–d is the triple deadfold test described above. For Examples e and f, the fiber damage method is to knit the fibers, deknit them, expose them to light, and then determine their final tensile strength. The test method used for Examples g–k is to knit the samples, expose them to light, and then deknit them prior to determining the final tensile strength. The tensile strength values reported in Table 1, as well as the rest of the tables herein, are measured after the fiber is damaged, and the two values reported for each compound are the average tensile strength of fibers which have been exposed to light, followed by the average tensile strength of fibers which have not.

TABLE 1

Photostabilty of PBO Fiber Imbibed with Ferrocene Compounds

| Ex. | Ferrocene | Ferrocene Solution Concentration, % | TS, ksi [100 hr hμ/ no hμ] | Tensile Strength Retention (%) |
|---|---|---|---|---|
| 1a | (ferrocenylmethyl)trimethylammonium iodide | 1 | 277/ 796 | 35 |
| 1b | 1,1'-ferrocence-dimethanol | 2 | 344/ 740 | 46 |
| 1c | Na ferroceneacetate | 0.8 | 229/ 768 | 30 |
| 1d | 2Na 1,1'-ferrocenedicarboxylate | 0.6 | 222/ 765 | 29 |
| 1e | (dimethylaminomethyl)-ferrocene | 2.1 | 194/ 642 | 30 |
| 1f | (dimethylaminomethyl)-ferrocene | 2.6 | 254/ 654 | 39 |
| 1g | ferrocenecarboxylic acid | 2.5[a] | 357/ 690 | 52 |
| 1h | 1,1'-ferrocene-dicarboxylic acid | 2.6[a] | 290/ 679 | 43 |
| 1j | 1,1'-ferrocene-dicarboxylic acid | 1.2[a,b] | 169/ 554 | 31 |
| 1k | 1,1'-ferrocene-dicarboxylic acid | 1.0[a,b] | 121/ 560 | 22 |

[a]Saturated ammonium ferrocenecarboxylate or diammonium ferrocenedicarboxylate solutions were used for imbibing. The ammonium salts in PBO fiber samples were converted to the acids by heat-treatment prior to testing.
[b]Fiber was passed through a ferrocene solution for 58 seconds or 29 seconds.

Example 2

PBO Fibers infiltrated With Ferrocenes; Knitted and De-knitted

PBO fibers are infiltrated with ferrocene compounds according to the "off-line" procedure described in Example 1, and then knitted into fabrics which are then de-knitted and photolyzed for 100 hours, according to the procedure described in Example 1. The tensile strength of fibers which have not been photolyzed are measured and compared with the tensile strength of fibers which have been photolyzed (Hv), and the results are shown below in Table 2.

TABLE 2

| Ferrocene | De-knitted TS (Ksi) | De-knitted, Hv TS (Ksi) | % TSR | Elongation at break |
|---|---|---|---|---|
| aminoferrocene (denier = 529, | 624 ± 38 | 213 ± 19[a] | 34 | 1.28 |
| Fe[b] = 1.68% ferrocene[c] = 7.3%) | 622 ± 31 | 149 ± 20 | 24 | 1.0 |
| ferrocenedimethanol (denier = 537, | 574 ± 80 | 136 ± 25 | 24 | 1.28 |
| Fe = 1.49% Ferrocene = 6.5%) | 584 ± 50 | 157 ± 17[a] | 27 | 1.34 |

[a]Samples are resoaked in the ferrocene solution prior to exposure to light.
[b]"Fe" refers to iron content of the fiber, as determined by X-ray fluorescence.
[c]"Ferrocene" refers to ferrocene content of the fiber.

Example 3

PBO Fibers Containing Dyes

Using the procedure described in Example 1 for ferrocenes, several samples of PBO fiber infiltrated with dyes are prepared and tested. The results are listed in Table 3. The fiber used in Examples 3a–d, 3e, and 3f–h are obtained from separate rolls of fiber. In Examples 3a–d, the dye is infiltrated by soaking the fiber in a 2 weight percent solution of the dye for 24 hours. In Example 3e, the fiber is infiltrated by spraying the fiber with a 2 percent solution of the dye as the fiber travels through a washing cabinet. In Examples 3f–g the polybenzazole dope used to prepare the filaments contains 2 percent by weight of the dye. Example 3h is prepared by end-capping a diaminoresorcinol-terminated polybenzoxazole polymer with Rhodamine B, which has pendant carboxyl groups which react with the end groups of the polymer at 160° C. in polyphosphoric acid.

TABLE 3

Photostability of Dyed PBO Fiber

| Ex. No. | Dye | Infiltration Method | Test Method | TS, ksi [100 h hμ/- no hμ] | TSR % |
|---|---|---|---|---|---|
| 3a | Acid Black 48 | soak | 3-DF | 278/746 | 37 |
| 3b | Acid Black 48 | soak | knitted-dek.-hμ | 78/742 | 11 |
| 3c | Acid Blue 25 | soak | 3-DF | 151/450 | 34 |
| 3d | Acid Green 25 Primulin Nuclear Fast Acid | soak | 3-DF | 151/741 | 21 |
| 3e | Acid Black 48 | spray | 3-DF | 21/558 | 4 |
| 3f | Acid Blue 40 Eosin Y, 4,5-Dibromo-fluorescein | blend | 3-DF | 196/583 | 37 |
| 3g | Naphthol Blue-Black | blend | 3-DF | 148/362 | 41 |
| 3h | Rhodamine B | end-cap | 3-DF | 217/629 | 35 |

It can be seen from the table that the retention of tensile strength values for Acid-Black, Acid-Blue, Naphthol-Blue and Rhodamine-B treated samples are between 35 percent to 40 percent using the triple dead-fold test.

Example 4

PBO Fiber Infiltrated with a Combination of Ferrocene and Dye

Using the procedure described in Example 1 for ferrocenes, several samples of PBO fiber infiltrated with a combination of ferrocene and dye are prepared and tested. Never-dried fiber samples are soaked in aqueous solutions of ferrocene compounds (1 percent solution) and Acid Black 48 (2 percent solution) for about 48 hours. The samples are tested according to the procedure described in Example 1 except that an Atlas Model Ci65A Weatherometer with xenon lamp and borosilicate filter is used instead of Suntest unit. As used in Table 4, "knitted-dek.-hv" means that the damage test procedure was to knit the fibers, deknit them, expose them to light, and determine their tensile strength. A portion of the samples infiltrated with a solution of ferrocenedimethanol and Acid Black 48 are coated with the infiltrating solutions after being damaged, although it does not make a significant difference in the tensile strength values obtained during testing. Fiber strands are mounted on sample holders and photo-exposed in the Weatherometer. The exposure is 765 watt/m$^2$ with 300 to 800 nm wave length for a total of 100 hours. The results are shown in Table 4. Table 4 shows that fibers treated with ferrocenes and dyes retain a high percentage of their tensile strength, after damage and 100 hours of light exposure in the Weatherometer.

TABLE 4

| Combinations of Ferrocenes and Acid Black 48 on PBO Fiber Photostabilty | | | |
|---|---|---|---|
| Ferrocene | Test Method | TS, ksi [100 h hμ/no hμ] | TSR (%) |
| ferrocenedimethanol and Acid Black 48 | 3 DF | 506/760 | 67 |
| Na ferrocenecarboxylate and Acid Black 48 | knitted-dek.-hμ | 166/653 | 26 |
| Acid Black | knitted-dek.-hμ | 82/675 | 12 |
| Na ferrocenecarboxylate | knitted-dek.-hμ | 150/673 | 22 |

Example 5

PBO Fiber Infiltrated With Iodide Containing Compounds, Copper-containing Compounds, and Mixtures Thereof; Off-line Continuous Infusion Process PBO fiber samples prepared as described in Example 1 with a denier of about 493 are infused with copper and iodide-containing compounds using the following method:

A one gallon capacity Plexiglass tank (7"×7"×7") is made for holding the infusion solutions. A pair of 1" diameter godet rolls is installed in the tank and driven by a motor. The infusion tank with the godet rolls is placed between a tank containing the wet filaments and a pair of heated godets. Fibers, stored in water in the supplying tank, pass through the infusion tank and the heated godets and are collected by a winder. The residence time of fiber in the infusion tank can be varied by the number of wraps of fiber on the 1" godets and the speed of travel.

$KI/CuBr_2$, $NH_4I/CuBr_2$, $LiI/CuBr_2$, $CaI_2/CuBr_2$, and $NaI/CuBr_2$ solution mixtures are prepared by mixing the iodide (available from Aldrich Chemical) and $CuBr_2$ (Aldrich Chemical) in 3300 cc water at various concentrations and iodide/copper weight ratios. The solution mixture is placed in the infusion tank described above, and the fibers are passed through the infusion tank at a rate which gives the desired residence time.

The fibers are damaged using the triple dead-folding (3-DF) method described in Example 1. The dead-folded samples contained a large number of kink bands localized at the folded regions as observed under the light microscope. Some samples are knitted using the procedure described in Example 1. Yarn samples are knitted with various knitting speeds ranging from a yarn meter spool setting of 3.3 to 4.0.

Photo-aging is carried out in an Atlas Model Ci65A Weatherometer with xenon lamp-and borosilicate filter. Fiber strands are mounted on sample holders and photo-exposed in the Weatherometer. The exposure is 765 watt/$m_2$ with 300 to 800 nm wave length for a total of 100 hours. Fibers are tested in an Instron™ testing machine with a twist factor of 3.5, gauge length of 4.5 inches and a strain rate of 0.02/min. The retention of tensile strength (TSR) is defined as (the photo-aged tensile strength/initial tensile strength)× 100 percent. The results are listed in Table 5. As used in Table 5, "de-knitted" means that the damage test procedure was to knit the fibers, deknit them, expose them to light, and determine their tensile strength. Fibers processed through the infusion bath show strong enhancement in the tensile strength retention. In the following table, "R.T." refers to the residence time of the fiber in the particular process step.

TABLE 5

| | Solution Soaking Conditions | | | | Continuous Additive Infusion | | | | | | | | |
|---|---|---|---|---|---|---|---|---|---|---|---|---|---|
| | | | | | Heated Godet | | | TS, ksi, 3-DF | | | TS, ksi, De-knitted | | |
| Example | Compound(s) | wt. % in solution | Ratio of compounds | R.T., seconds | T °C. | R.T., seconds | Tension grams per denier | no light exposure | light exposure | % TSR | no light exposure | light exposure | % TSR |
| 5a | $KI/CuBr_2$ | 5 | 80/20 | 15–30 | 23 | | | 681–715 | 258–278 | 36.1–40.8 | | | |
| 5b | $KI/CuBr_2$ | 5 | 80/20 | 10 | 23 | | 2 | 677 | 255 | 37.7 | | | |
| 5c | $KI/CuBr_2$ | 5 | 80/20 | 10–30 | 150 | 25–50 | 1–1.5 | 593–608 | 190–219 | 31.1–36.9 | | | |
| 5d | $KI/CuBr_2$ | 8 | 80/20 | 10–30 | 23 | | 1 | 675–688 | 264–286 | 39.1–41.9 | 612–640 | 191–256 | 29.8–41.8 |
| 5e | $KI/CuBr_2$ | 8 | 80/20 | 10–30 | 150 | 18–50 | 1 | 623–629 | 219–257 | 35.1–40.9 | | | |
| 5f | $KI/CuBr_2$ | 8 | 80/20 | 5–8 | 23 | | <1 | 710–726 | 233–237 | 32.6–32.8 | 632–642 | 188–191 | 29.3–30.2 |
| 5g | $KI/CuBr_2$ | 8 | 80/20 | 5–8 | 150 | 18–25 | <1 | 680–686 | 200–222 | 29.4–32.4 | | | |
| 5h | $KI/CuBr_2$ | 8 | 80/20 | 60 | 23 | | 2 | 651 | 282 | 43.3 | 595 | 272 | 45.7 |
| 5j | $NH_4I$ | 5 | | 29 | 23 | | 1.5 | 656 | 258 | 39.3 | 627 | 264 | 42.1 |
| 5k | $NH_4I$ | 5 | | 6–14 | 23 | | 1.5 | 665–731 | 274–305 | 37.5–45.9 | | | |
| 5m | $NH_4I/CuBr_2$ | 5 | 98.25/–1.75 | 5–30 | 23 | | 0.5–1.5 | 664–683 | 290–312 | 43–46.3 | 627–685 | 248–261 | 38.1–41 |
| 5n | $NH_4I/CuBr_2$ | 5 | 90/10 | 31 | 23 | | 1.5 | 581 | 291 | 50.1 | 612 | 219 | 35.8 |
| 5p | $NH_4I/CuBr_2$ | 5 | 90/10 | 5–15 | 23 | | 0.5–1.5 | 618–646 | 242–271 | 39.5–42.7 | | | |
| 5q | LiI | 5 | | 8–30 | 23 | | 0.5–1.5 | 680–727 | 272–282 | 38.4–40.1 | | | |
| 5r | $LiI/CuBr_2$ | 5 | 98.17/1.83 | 8–30 | 23 | | 0.5–1.5 | 662–691 | 245–251 | 36.2–37.9 | | | |
| 5s | $LiI/CuBr_2$ | 5 | 92.7/7.3 | 7–52 | 23 | | 0.5–1.5 | 594–612 | 189–235 | 31.8–38.5 | | | |
| 5t | $CaI_2$ | 5 | | 7–30 | 23 | | 1.5 | 725–739 | 306–377 | 41.4–52 | 668–694 | 223–252 | 33.4–36.3 |
| 5u | $CaI_2$ | 5 | | 15–52 | 23 | | 1–1.5 | 705–710 | 314–315 | 44.2–44.7 | | | |
| 5v | $CaI_2/CuBr_2$ | 5 | 98.2/1.8 | 8–53 | 23 | | 1.5 | | | | 651–696 | 227–271 | 32.6–41.6 |

Example 6

PBO Infiltrated With Iodide-Containing Compounds, Copper-containing Compounds, and Mixtures Thereof; Off-line Static Infusion Process 1 or 2 grams of copper-containing compounds are dissolved in 100 cc water in a glass beaker to form a uniform solution at room temperature. Wet, never dried, as-spun PBO fiber (washed; about 500 denier) is wound on a 1" diameter glass bottle. The wound fiber samples are immersed in the solution for various time periods. The bottle samples are subsequently dried for damage and photo-aging tests. The fibers are then damaged using the triple dead-folding (3-DF) procedure describe in Example 1. A portion of the samples are coated with the solution of the compound. Photo-aging tests are performed as described in Example 6.

The photo-aging test results are listed in Table 6. The average tensile strength values are shown for fibers which have not been exposed to light ("cntl") and those which have been exposed to light ("sun"). Fibers soaked with these solutions showed strong enhancement in tensile strength retention.

TABLE 6

PBO Fiber Treated with Copper and Iodide Compounds

| Example | Additives | | | Damage Test (3-DF) | | | |
|---|---|---|---|---|---|---|---|
| Number | Compound | Conc. in $H_2O$ | Soaking | TS, cntl, Ksi | TS, sun, Ksi | % TSR | Drying Conditions |
| 6a | $CuBr_2$ | 1 g/100 cc | 48 hrs | 468 | 221 | 47% | |
| 6b | $CuBr_2$ | 2 g/100 cc | 48 hrs | 385 | 224 | 58% | |
| 6c | CuBr | 1 g/100 cc | 48 hrs | 566 | 144 | 25% | |
| 6d | Cu-acetate | 1 g/100 cc | 48 hrs | 610 | 168 | 28% | |
| 6e | Cu-acetate | 1 g/100 c | 16 hrs | 531 | 126 | 24% | 120° C. 3 hrs dried |
| 6f | Cu-acetate | 3 g/100 cc | 16 hrs | 603 | 178 | 30% | 120° C. 3 hrs dried |
| 6g | $CuCl_2$ | 2 g/100 cc | 30 min | 685 | 112 | 16% | |
| 6h | $CuCl_2$ | 2 g/100 cc | 60 min | 452 | 219 | 49% | |
| 6i | CuCl | 2 g/100 cc | 60 min | 640 | 114 | 18% | |
| 6j | Cu-chromite | 1 g/100 cc | 48 hrs | 626 | 103 | 17% | |

PBO Fiber Treated with I-Based Compounds

| Example | Additives | | | Damage Test (3-DF) | | |
|---|---|---|---|---|---|---|
| Number | Compound | Conc. in $H_2O$ | Soaking | TS, cntl, Ksi | Ts, sun, Ksi | % TSR |
| 6k | KI | 1 g/100 cc | 48 hrs | 648 | 191 | 29% |
| 6m | KI | 2 g/100 cc | 48 hrs | 698 | 250 | 36% |
| 6n | $CaI_2$ | 2 g/100 cc | 24 hrs | 611 | 305 | 50% |
| 6p | LiI | 2 g/100 cc | 24 hrs | 662 | 251 | 38% |
| 6q | NaI | 2 g/100 cc | 24 hrs | 665 | 262 | 39% |
| 6r | $NH_4I$ | 2 g/100 cc | 30 min | 710 | 249 | 35% |
| 6s | $CrI_2$ | 1 g/100 cc | 48 hrs | 531 | 183 | 35% |
| 6t | $KI/CuBr_2$ | 2 g/1 g/100 cc | 48 hrs | 572 | 375 | 66% |
| 6u | $KI/CuBr_2$ | 2 g/0.5 g/100 cc | 48 hrs | 630 | 380 | 60% |
| 6v | $KI/CuBr_2$ | 2 g/0.1 g/100 cc | 48 hrs | 660 | 335 | 51% |
| 6w | $KI/CuBr_2$ | 1 g/1 g/100 cc | 48 hrs | 533 | 319 | 60% |
| 6x | $KI/CuBr_2$ | 1 g/0.5 g/100 cc | 48 hrs | 573 | 307 | 54% |
| 6y | $KI/CuBr_2$ | 1 g/0.1 g/100 c | 48 hrs | 703 | 294 | 42% |

PBO Fiber Treated with Solution Mixtures of Cu- and I-Based Compounds

| Example | Additives | | | | Damage Test (3-DF) | | |
|---|---|---|---|---|---|---|---|
| Number | Compound | Conc in $H_2O$ | Soaking | Coating | Ts, cntl, Ksi | TS, sun, Ksi | % TSR |
| 6z | KI/Cu-acetate | 1 g/1 g/100 cc | 48 hrs | yes | 601 | 246 | 41% |
| 6aa | KI/CuCl | 4 g/1 g/100 cc | 30–60 min | none | 708 | 241 | 34% |
| 6bb | $NH_4I/CuBr_2$ | 4 g/1 g/100 cc | 30 min | none | 611 | 298 | 49% |
| 6cc | $CaI_2/CuBr_2$ | 4 g/1 g/100 cc | 10 min | none | 681 | 303 | 45% |
| 6dd | $LiI/CuBr_2$ | 4 g/1 g/100 cc | 10 min | none | 565 | 202 | 36% |
| 6ee | $NaI/CuBr_2$ | 4 g/1 g/100 cc | 10 min | none | 725 | 248 | 34% |
| 6ff | $CrI_2$/Cu-acetate | 0.5 g/0.5 g/100 cc | 48 hrs | none | 625 | 225 | 36% |
| 6gg | $CrI_2/CuBr_2$ | 0.5 g/0.5 g/100 cc | 48 hrs | none | 427 | 234 | 55% |
| 6hh | $KI/Cu_2Br_2$ | 0.5 g/0.5 g/100 c | 48 hrs | yes | 656 | 169 | 26% |
| 6jj | $KI/CuSO_4$ | 1 g/1 g/100 c | 48 hrs | none | 542 | 304 | 56% |

Drying: 24–48 hrs in a nitrogen purged tank at room temperature, unless otherwise noted.
Damage Test: 3-dead-folds of fiber strands on paper substrates, ½ inch apart.

What is claimed is:

1. A method for preparing a polybenzazole filament which comprises extruding a polybenzazole dope filament, drawing the filament across an air gap, washing the filament, and drying the filament, characterized in that a solution of a compound selected from the group consisting of ferrocenes, ruthocene, iodide-, cobalt-, and copper-containing compounds, dyes, and mixtures thereof is contacted with a filament subsequent to the washing step and prior to the drying step.

2. The process of claim 1 wherein the filament contains at least about 0.1 percent by weight of the compound, after the drying step.

3. The process of claim 1 wherein the filament contains at least about 0.5 percent by weight of the compound, after the drying step.

4. The process of claim 1 wherein the filament contains at least about 1.0 percent by weight of the compound, after the drying step.

5. The process of claim 1 wherein the filament contains at least about 1.5 weight percent of the compound, after the drying step.

6. The process of claim 1 wherein the solution of the compound is an aqueous solution.

7. The process of claim 1 wherein the compound is a ferrocene compound.

8. The process of claim 1 wherein the compound is ruthocene.

9. The process of claim 1 wherein the compound is an iodide-containing compound.

10. The process of claim 9 wherein the compound is potassium iodide or sodium iodide.

11. The process of claim 1 wherein the compound is a copper-containing compound.

12. The process of claim 11 wherein the compound is copper (II) bromide.

13. The process of claim 1 wherein the compound is a cobalt-containing compound.

14. The process of claim 13 wherein the compound is cobalt (II) acetate.

15. The process of claim 1 wherein the compound is Acid Black 48, Acid Blue 29, Primulin, Nuclear Fast Red, Acid Blue 40, Eosin Y (4,5-tetrabromofluorescein), Naphthol Yellow S, Rhodamine B, or a mixture thereof.

16. A method for preparing a polybenzazole filament which comprises extruding a polybenzazole dope filament, drawing the filament across an air gap, coagulating and washing the filament, and drying the filament, characterized in that the polybenzazole dope comprises at least about 0.5 percent by weight, based on the weight of the polybenzazole polymer, of a dye compound.

17. The method of claim 16 wherein the polybenzazole dope comprises at least about 1.0 percent by weight, based on the weight of the polybenzazole polymer, of a dye compound.

18. The method of claim 16 wherein the polybenzazole dope comprises at least about 1.5 percent by weight, based on the weight of the polybenzazole polymer, of a dye compound.

19. The method of claim 16 wherein the polybenzazole dope comprises at least about 2.0 percent by weight, based on the weight of the polybenzazole polymer, of a dye compound.

20. The method of claim 16 wherein the polybenzazole dope comprises no more than about 10.0 percent by weight, based on the weight of the polybenzazole polymer, of a dye compound.

21. The method of claim 21 wherein the dye compound is Acid Black 48, Acid Blue 29, Primulin, Nuclear Fast Red, Acid Blue 40, Eosin Y (4,5-tetrabromofluorescein), Naphthol Yellow S, Rhodamine B, or a mixture thereof.

22. The method of claim 21 wherein the solution additionally comprises a ferrocene compound.

* * * * *